US007497396B2

(12) United States Patent
Splinter et al.

(10) Patent No.: US 7,497,396 B2
(45) Date of Patent: Mar. 3, 2009

(54) GRINDING ROLLER FOR THE PRESSURE COMMINUTION OF GRANULAR MATERIAL

(75) Inventors: Christian Splinter, Pulheim (DE); Meinhard Frangenberg, Kürten (DE); Frank Fischer-Helwig, Sankt Augustin (DE); Dieter Brendler, Bergisch Gladbach (DE)

(73) Assignee: KHD Humboldt Wedag GmbH, Cologne (DE)

( * ) Notice: Subject to any disclaimer, the term of this patent is extended or adjusted under 35 U.S.C. 154(b) by 110 days.

(21) Appl. No.: 10/579,482

(22) PCT Filed: Nov. 22, 2004

(86) PCT No.: PCT/EP2004/013234

§ 371 (c)(1),
(2), (4) Date: Jan. 22, 2007

(87) PCT Pub. No.: WO2005/049212

PCT Pub. Date: Jun. 2, 2005

(65) Prior Publication Data

US 2007/0215733 A1 Sep. 20, 2007

(30) Foreign Application Priority Data

Nov. 22, 2003 (DE) ..... 103 54 679

(51) Int. Cl.
*B02C 4/30* (2006.01)

(52) U.S. Cl. ..... 241/294; 241/300

(58) Field of Classification Search ..... 241/293, 241/294, 295, 300, 235; 492/28, 30, 31, 492/47; 100/176
See application file for complete search history.

(56) References Cited

U.S. PATENT DOCUMENTS

| | | | |
|---|---|---|---|
| 412,558 | A | 10/1889 | Stephens |
| 5,000,392 | A | 3/1991 | Kästingschäfer et al. |
| 5,269,477 | A | 12/1993 | Buchholtz et al. |

FOREIGN PATENT DOCUMENTS

| | | |
|---|---|---|
| DE | 4032615 | 4/1992 |
| DE | 4400797 | 7/1995 |
| EP | 0396897 | 11/1990 |
| EP | 0516952 | 9/1992 |
| EP | 1502650 | 2/2005 |

*Primary Examiner*—Mark Rosenbaum
(74) *Attorney, Agent, or Firm*—Greer, Burns & Crain Ltd

(57) ABSTRACT

The aim of the invention is to provide grinding rolls in particular for high-pressure roller mills or rolling presses for pressure grinding a granular material not only with a wear-resistant coating but also with a face armour plating in the area of the roller annular edge, which has a long service life due to the high wear resistance thereof and whose production and repair are, in general, relatively simple and inexpensive. For this purpose, the inventive face armour plating consists of a plurality of prefabricated hard bodies which are circularly arranged side by side in such a way that the circular face edge of the roller is formed, said hard bodies are disposed on said circular shoulder of a roll shell such that said hard bodies are placed axially and radially against said circular shoulder of the roll shell and are movably assembled with the roll shell.

18 Claims, 3 Drawing Sheets

Fig. 3
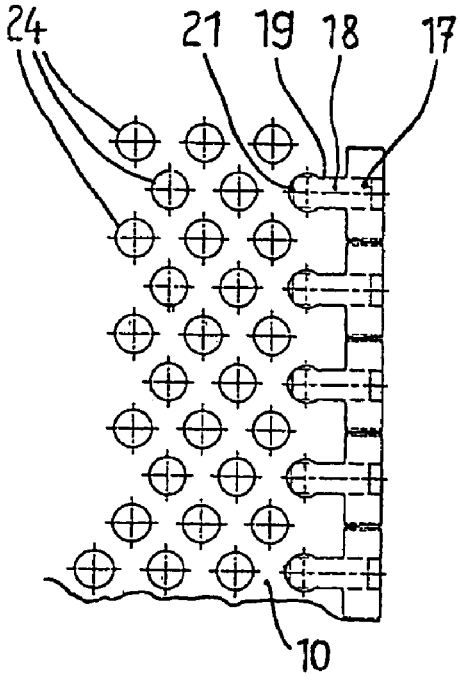
Fig. 5
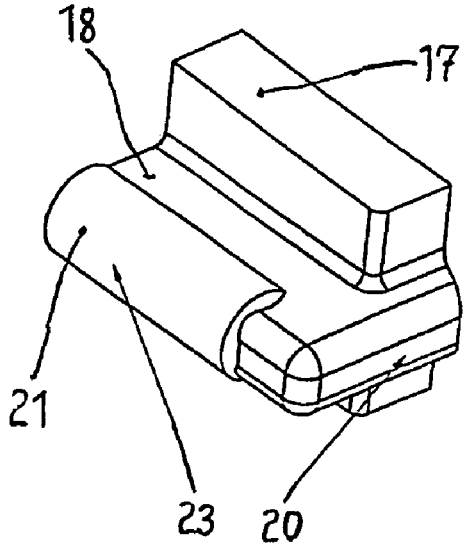
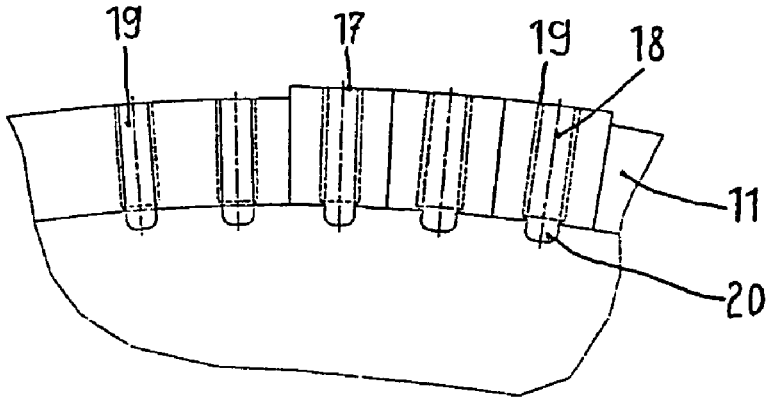
Fig. 4

GRINDING ROLLER FOR THE PRESSURE COMMINUTION OF GRANULAR MATERIAL

BACKGROUND OF THE INVENTION

The invention relates to a grinding roller for the pressure comminution of granular material, in particular for rolling presses for comminuting a bed of material, having a roller shell with wear-resistant surface reinforcement, suitable in particular for autogenous wear protection, and with end-face reinforcement.

In the case of rolling mills, granular, brittle material to be ground is drawn into the roller nip, by which the two rotatably mounted, counter-rotating rollers are separated from each other, and is subjected there to pressure comminution. Also known is so-called material-bed comminution in the roller nip of a high-pressure rolling mill, also known as a rolling press, in which the individual particles of the material to be ground that is drawn into the roller nip by friction are squeezed against one another in a bed of material, i.e. in a charge of material compressed between the two roller surfaces, when a high pressure is applied. The surfaces of the rollers thereby undergo a high level of wearing stress. Therefore, such roller surfaces have to meet at least the following requirements:

They should have high wear resistance, be able to be produced at low cost, be able to be repaired by the operator of the rolling press and also have good drawing-in characteristics for the material to be comminuted.

It is known to make the roller surfaces of rolling presses more resistant to wear by arranging on the roller surface a multiplicity of prefabricated hard metal bodies, such as stud bolts for example, which can be incorporated in corresponding blind-hole bores of the roller shell (EP-B-0 516 952 FIG. 2).

In the case of this so-called grid armoring, the stud bolts protrude outward from the roller surface to such a great height and are arranged at such a distance from one another that, during operation of the rolling press, on the roller surface the interstices between the stud bolts remain filled with the pressed-together fine-grained material, which forms autogenous wear protection for the roller surfaces and, on account of its roughness, also has good drawing-in characteristics. This known roller surface reinforcement with alternating zones of highly wear-resistant material and intermediate spatial zones of other wear resistance has proven to be successful in practice in the material bed comminution of ore material in particular.

However, the end faces of the rollers or the roller shells of rolling presses are also subjected to high levels of wear, in particular when they are used for ore crushing. It is known from DE-C-40 32 615 to reinforce the end faces of the rollers of rolling presses in the region of the peripheral edge of the roller by applying welding material to this region by build-up welding. Apart from the fact that it is questionable whether operators of such machines are capable of building up the wear protection themselves in the case of repair, the wear resistance is limited, because the welding technique cannot be used for applying very hard materials. It has already been attempted to protect the end faces of rolling presses by wear plates in the form of segments of a circle, which are welded at least onto the outer circumference of the roller shell. If these welded-on plates become worn in the course of operating the rolling press, material may be pressed into the radial gap between the end face of the roller and the wear plate and the wear plate forced out of its anchorage, so that the effort involved in maintaining this kind of wear protection for a grinding roller end face is considerable.

SUMMARY OF THE INVENTION

The invention is based on the object of providing particularly the grinding rollers of high-pressure rolling mills or rolling presses for the pressure comminution of granular material not only with surface reinforcement but also with end-face reinforcement in the region of the peripheral edge of the rollers, which has a long service life as a result of high wear resistance and which can nevertheless be produced and repaired relatively easily and with low overall cost.

This object is achieved according to the invention by a grinding for the pressure comminution of granular material, in particular for rolling presses for comminuting a bed of material, having a roller shell with wear-resistant surface reinforcement, suitable in particular for autogenous wear protection, and with end-face reinforcement wherein the end face reinforcement comprises a multiplicity of prefabricated hard bodies arranged in series to form a circle and forming a peripheral end edge of the roller, at the end edge of the roller, the hard bodies are arranged in a peripheral annular shoulder of the roller shell, are supported both axially and radially on the annular shoulder of the roller shell and are detachably connected to the roller shell, and the hard bodies protrude both axially from the end face and radially from the surface of the roller shell.

In the case of the grinding roller according to the invention, the end face reinforcement does not comprise material built up by surface welding or welded-on wear plates, but a multiplicity of prefabricated hard bodies, in particular of sintered hard metal, arranged in series to form a circle and forming the peripheral end edge of the roller. At its peripheral edge, the end face of the roller has a peripheral annular shoulder, in which the hard bodies are arranged, supported both axially and radially on the annular shoulder of the roller shell and detachably connected to the roller shell. In this case, the depth of the annular shoulder and the size of the hard bodies may be dimensioned in such a way that the hard bodies protrude both radially from the surface of the roller shell and axially from the end face of the roller shell, whereby the reinforcement according to the invention is in principle made suitable for autogenous wear protection. In any event, the grinding roller according to the invention with its reinforcement has a long service life. In this case, the service life of the end face reinforcement corresponds approximately to the service life of the roller surface reinforcement.

It is relatively easy to secure the hard bodies in the annular shoulder of the roller shell, so that the reinforcement can also be repaired by the operator of the rolling machine. According to one embodiment of the invention, the hard bodies may be clamped in the peripheral annular shoulder of the roller shell by means of screwing and wedging elements distributed over the periphery of the roller end face. The screw connections of the hard bodies with their annular shoulder may act axially and/or radially or obliquely diagonal. Instead of screwing the hard bodies onto the roller shell directly through corresponding bores by means of through-bolts, the hard bodies may also be clamped into the annular shoulder by means of clamping plates, which for their part are screwed onto the roller end face in a region lying radially more inward, where they are no longer exposed to wear.

The radially inner surfaces of the hard bodies in the form of segments of a circle, by which they are radially supported on the annular shoulder of the roller shell, may be adapted to the cylindrical contour of the annular shoulder by being arcuately curved in a convex manner. The radially inner hard body surface may, however, also be planar, in this case the radially inner contour of the annular shoulder representing a polygon. With a planar fit, even greater fitting accuracy of the hard bodies can be achieved.

According to one particular feature of the invention, the hard bodies may also have, seen in plan view, the shape of a hammerhead with a shaft, the hammerhead respectively being arranged in the annular groove of the roller shell and the shaft respectively being inserted in formed-in or milled-in radial/axial grooves distributed around the circumference of the roller end face. If the roller shell comprises a cast body, for example of chilled cast iron, there is the possibility of forming the annular shoulder and the radial/axial grooves in the roller shell already when it is cast, so that it is possible to dispense with machining operations.

According to another feature of the invention, the shaft of the hammerhead-shaped hard bodies may have at the end a cylindrical thickening, which is respectively made to fit in the radial bores of the outer series of bores adjacent the edge of the roller shell of the roller end face, so that the hard bodies are axially captured in the roller shell by this thickening, i.e. are secured in the axial direction against falling out, while the radial fixing of the hammerhead-shaped hard bodies can be achieved by them being adhesively bonded or soldered in their radial grooves. The adhesive bonding or soldering is intended to be reversible at low temperatures, to make it easier for worn hard bodies to be exchanged.

BRIEF DESCRIPTION OF THE DRAWINGS

The invention and its further features and advantages are explained in more detail on the basis of the exemplary embodiments schematically represented in the figures, in which:

FIG. 3 shows a second embodiment of the end face reinforcement according to the invention in the form of a detail seen in plan view of the roller, FIG. 4 shows the view of the end face reinforcement of FIG. 3 seen from the right-hand side, and FIG. 5 perspectively shows the configuration of the hard bodies that are inserted in FIG. 3, taken as an enlarged extract.

DETAILED DESCRIPTION OF THE PREFERRED EMBODIMENTS

Figure 1:
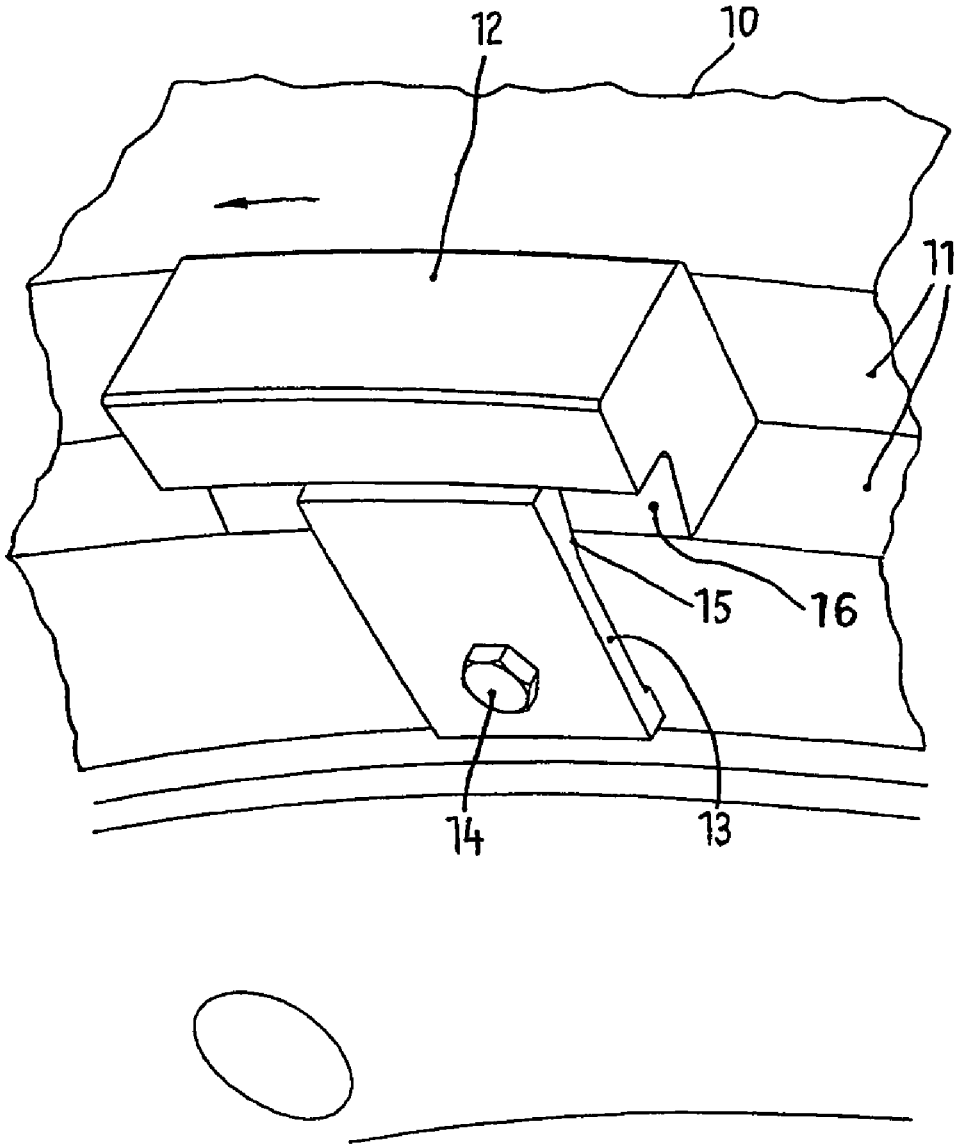
FIG. 1 shows in an enlarged perspective view a detail from the end edge of a grinding roller as a first embodiment of the end face reinforcement according to the invention, FIG. 2 perspectively shows the view of the complete grinding roller end face provided with the end face reinforcement that is represented in the enlarged detail in FIG. 1.

FIG. 1 shows, seen obliquely from above, the roller shell 10 of a grinding roller, on the end edge of which a peripheral annular shoulder 11 is integrally formed. Arranged in this annular shoulder are a multiplicity of prefabricated hard bodies, in particular of sintered hard metal, arranged in series to form a circle and forming the peripheral end edge of the roller, of which the inserted approximately right-parallelepipedal hard body 12 can be seen in FIG. 1, supported both axially and radially on the annular shoulder 11 of the roller shell 10 and detachably connected to it. The hard bodies 12 protrude both axially from the end face and radially from the surface of the roller shell 10, that is to say the height of the hard bodies 12 coincides with the surface reinforcement or grid armoring mentioned at the beginning, should this be present on the cylindrical surface of the roller shell 10 for the purpose of autogenous wear protection.

The radially inner surfaces of the hard bodies 12, by which they are radially supported on the annular shoulder 11 of the roller shell, are arcuately curved in a convex manner or planar in a flat manner, in the latter case the radially inner contour of the annular shoulder 11 representing a polygon for the purpose of achieving a planar fit. The hard bodies 12 may be screwed directly onto the roller end face by means of through-bores and screw bolts, with screw bolts which lie axially, radially sunken or obliquely diagonal, in the latter case the screws accepting both radial and axial forces.

According to FIG. 1, the hard bodies 12 are clamped in the peripheral annular shoulder 11 of the roller shell 10 by means of clamping plates 13 distributed over the circumference of the roller end face. For this purpose, the clamping plates 13 respectively have a screw 14 and a wedge surface 15, which interacts with a corresponding wedge surface 16 in the radially inner region of the hard body 12.

Figure 2:
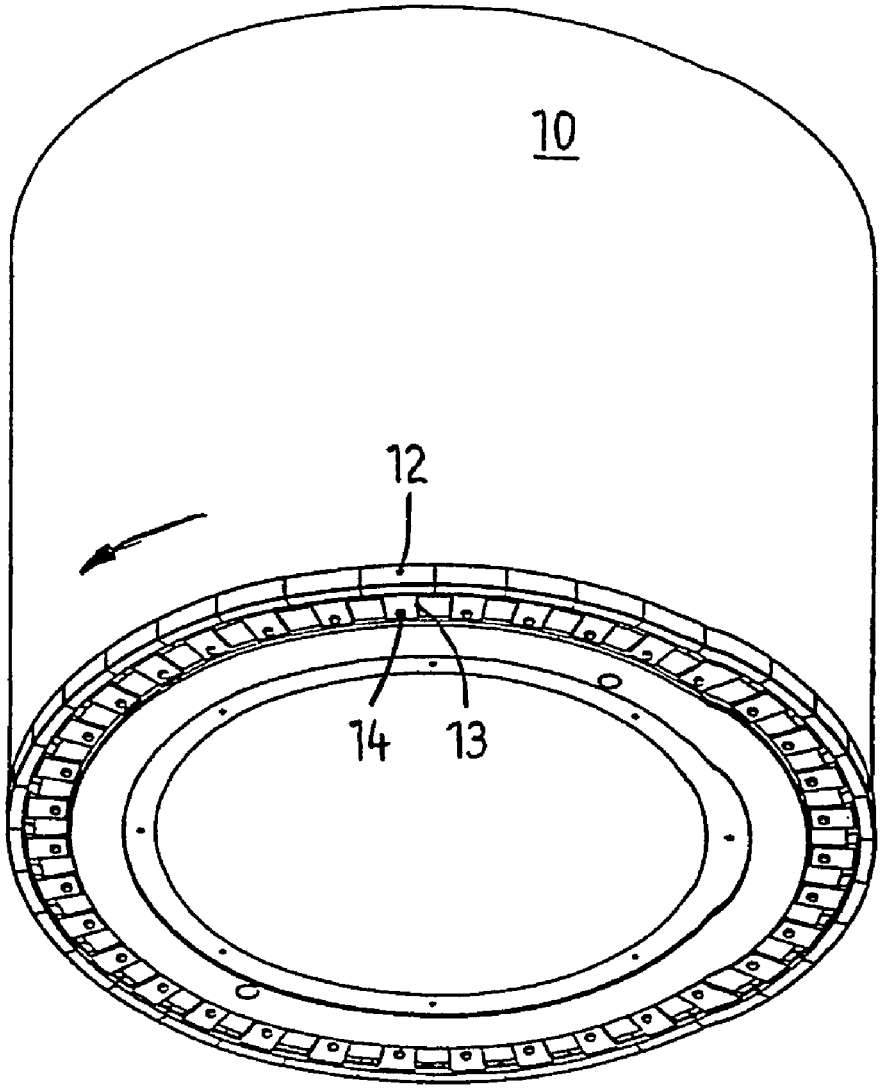

In FIG. 2, the complete end face reinforcement of the roller shell 10 with the multiplicity of hard bodies 12, clamping elements 13 and securing elements 14 can be seen.

FIG. 3 shows a variant of the roller end face reinforcement according to the invention, in which the hard bodies may have, seen in plan view, the shape of a hammerhead 17 with a shaft 18, the hammerhead respectively being arranged in the annular groove 11 of the roller shell and the shaft 18 respectively being inserted in formed-in or milled-in radial/axial grooves 19 distributed around the circumference of the roller end face.

In FIG. 4 it can be seen that the hammerhead-shaped hard bodies 17 are radially supported only over the underside 20 of the shaft 18 at the base of the groove 19 and not on the annular shoulder 11 of the roller shell. In this way, double fits are avoided.

In FIG. 5, a hammerhead-shaped hard body 17 that is inserted in FIGS. 3 and 4 is taken as a perspective and enlarged extract. The shaft 18 of the hammerhead-shaped hard bodies 17 has at the end a cylindrical thickening 21, which is respectively made to fit in the radial bores of the outer series of bores adjacent the edge of the roller shell of the roller end face, so that the hard bodies 17 are axially captured in the roller shell 10 by this thickening 21, i.e. are secured in the axial direction against falling out. For the radial fixing of the hammerhead-shaped hard bodies 17, they are adhesively bonded or soldered in their grooves 19. For the purpose of allowing hard bodies 17 that are damaged for instance to be exchanged, the adhesive bonding or soldering is reversible at low temperatures. It can also be seen from FIG. 5 that the hard body element 17 is radially supported only over the underside 20 of the shaft 18, and is axially supported on the roller shell only over the rear side 23 of the cylindrical thickening 21.

FIG. 3 also reveals that the end face reinforcement according to the invention with the hard bodies 17 is integrated in the grid armoring for the autogenous wear protection of the roller surface with the multiplicity of inserted stud bolts 24, which also means that the hard bodies 17 protrude radially from the cylindrical surface of the roller shell 10 to the same extent as the stud bolts 24.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A grinding roller for the pressure comminution of granular material for rolling presses for comminuting a bed of material, having a roller shell with wear-resistant surface reinforcement, suitable for autogenous wear protection, and with end-face reinforcement, wherein the end face reinforcement comprises a multiplicity of prefabricated hard bodies arranged in series to form a circle and forming a peripheral end edge of the roller, at the end edge of the roller, the hard bodies are arranged in a peripheral annular shoulder of the roller shell, are supported both axially and radially on the annular shoulder of the roller shell and are detachably connected to the roller shell, and the hard bodies protrude both axially from the end face and radially from the surface of the roller shell.

2. The grinding roller as claimed in claim 1, wherein the hard bodies are clamped in the peripheral annular shoulder of the roller shell by means of screwing and clamping elements distributed over a periphery of the roller end face.

3. The grinding roller as claimed in claim 1, wherein the annular shoulder has a circular circumference and the radially inner surfaces of the hard bodies, by which they are radially supported on the annular shoulder of the roller shell, are arcuately curved in a convex manner.

4. The grinding roller as claimed in claim 1, wherein the annular shoulder has a polygonal circumference and the radially inner surfaces of the hard bodies are planar.

5. The grinding roller as claimed in claim 1, wherein the hard bodies have, seen in plan view, the shape of a hammerhead with a shaft, the hammerhead respectively being arranged in the annular groove of the roller shell and the shaft respectively being inserted in formed-in, radial/axial grooves distributed around a circumference of the roller end face.

6. The grinding roller as claimed in claim 5, the shaft of the hammerhead-shaped hard bodies has at the end a cylindrical thickening, which is respectively made to fit in the radial bores of the outer series of bores adjacent the edge of the roller shell of the roller end face, so that the hard bodies are axially secured in the roller shell by this thickening.

7. The grinding roller as claimed in claim 6, wherein, for the radial fixing of the hammerhead-shaped hard bodies, they are one of adhesively bonded and soldered in their radial grooves.

8. The grinding roller as claimed in claim 6, the hammerhead-shaped hard bodies are radially supported only over the underside of the shaft at the base of the groove and not on the annular shoulder of the roller shell.

9. The grinding roller as claimed in claim 5, the hammerhead-shaped hard bodies are radially supported only over the underside of the shaft at the base of the groove and not on the annular shoulder of the roller shell.

10. A grinding roller for the pressure comminution of granular material having a roller shell with wear-resistant surface reinforcement at a cylindrical surface and with reinforcement at each end face, comprising:

a plurality of prefabricated hard bodies arranged in series to form a circle and forming a peripheral end edge of the roller, at both ends of the roller, a peripheral annular shoulder formed at each end of the roller shell to support the hard bodies axially and radially, the hard bodies being detachably connected to the roller shell, and the hard bodies protruding both axially from the end faces and radially from the surface of the roller shell.

11. The grinding roller of claim 10, wherein the hard bodies are clamped on the peripheral annular shoulder of the roller shell by means of screwing and clamping elements distributed over a periphery of each of the roller shell end faces.

12. The grinding roller of claim 10, wherein each peripheral annular shoulder is circular and the radially inner surfaces of the hard bodies, by which they are radially supported on the annular shoulder of the roller shell, are arcuately curved in a convex manner.

13. The grinding roller of claim 10, wherein each peripheral annular shoulder is polygonal and the radially inner surfaces of the hard bodies, by which they are radially supported on the annular shoulder of the roller shell, are planar.

14. The grinding roller of claim 10, wherein the hard bodies have the shape of a hammerhead with a shaft, the hammerheads being arranged in an annular groove formed by the annular shoulder in the roller shell, and the roller shell has grooves that extend radially and axially, distributed around a circumference of the roller end faces, the shafts being inserted in the radial/axial grooves.

15. The grinding roller of claim 14, wherein the radial/axial grooves are formed by radial bores in the cylindrical surface having a selected diameter and axial grooves extending from the end faces to the radial bores, the axial grooves having a width less than the selected diameter of the radial bores, and the shafts of the hammerhead-shaped hard bodies have at an end a cylindrical thickening sized to closely fit in the radial bores, and having a diameter greater than the width of the axial grooves, so that the hard bodies are axially secured in the roller shell by this thickening.

16. The grinding roller of claim 15, wherein, for the radial fixing of the hammerhead-shaped hard bodies, they are one of adhesively bonded and soldered in the radial/axial grooves.

17. The grinding roller of claim 16, wherein the hammerhead-shaped hard bodies are radially supported only over an underside of the shaft at a base of the groove and not on the annular shoulder of the roller shell.

18. The grinding roller of claim 14, wherein the hammerhead-shaped hard bodies are radially supported only over an underside of the shaft at a base of the groove and not on the annular shoulder of the roller shell.

* * * * *